United States Patent [19]

Rumsey et al.

[11] 4,354,342

[45] Oct. 19, 1982

[54] TWISTER RING AND TRAVELER

[75] Inventors: Robert M. Rumsey, College Park; Robert W. Thornton, Douglasville, both of Ga.

[73] Assignee: Standard Oil Company (Indiana), Chicago, Ill.

[21] Appl. No.: 152,160

[22] Filed: May 22, 1980

Related U.S. Application Data

[62] Division of Ser. No. 7,955, Jan. 31, 1979, Pat. No. 4,246,746.

[51] Int. Cl.[3] ..... D01H 7/52

[52] U.S. Cl. ..... 57/119; 57/122; 57/125

[58] Field of Search ..... 57/119, 122, 125, 279

[56] References Cited

U.S. PATENT DOCUMENTS

| | | | |
|---|---|---|---|
| 2,083,724 | 6/1937 | Major | 57/279 |
| 2,198,791 | 4/1940 | Schaaff | 57/119 |
| 2,294,453 | 9/1942 | Harrison | 57/119 |
| 2,367,361 | 1/1945 | Lodge | 57/119 |
| 2,550,761 | 5/1951 | Blackwood | 57/279 X |
| 3,583,146 | 6/1971 | Myers | 57/125 X |
| 3,903,689 | 9/1975 | Chilpan | 57/119 |

FOREIGN PATENT DOCUMENTS

| | | | |
|---|---|---|---|
| 919990 | 9/1954 | Fed. Rep. of Germany | 57/125 |
| 2212946 | 3/1972 | Fed. Rep. of Germany . | |
| 832074 | 4/1960 | United Kingdom | 57/125 |

OTHER PUBLICATIONS

Journal of the Textile Institute, vol. 12, Ring and Traveler Designs and Speeds, 1932.

*Primary Examiner*—Donald Watkins

*Attorney, Agent, or Firm*—David E. Boone; William T. McClain; William H. Magidson

[57] ABSTRACT

A method and apparatus for winding and twisting yarn onto a spool directly from an extrusion line or other production source by means of an inline twister. The inline twister comprises the following elements: a rotatable spindle, a bottom flange securely fastened to the spindle having a catch on the outer periphery, a removable interlocking top flange positioned on the spindle, means for positioning the spool concentrically about the spindle, a twister ring concentrically positioned about the spindle having a slit, and a rotatable traveler positioned on the twister ring having a hook inwardly directed toward the spindle.

The method of winding and twisting the yarn onto a spool comprises guiding the yarn adjacent to the spool. This yarn is then positioned adjacent to the slit in the twister ring and is allowed to pass therein. The spindle on which the spool is contained is then rotated so that the catch-equipped bottom flange contacts the yarn and holds it tight. As the yarn is rotated by the bottom flange it contacts the hook equipped rotatable traveler positioned on the twister ring and this combination of rotating flange and traveler provides the means for inserting twist into the yarn as well as wrapping the yarn about the spool. As the yarn is wound about the spool the twister ring is reciprocated so that the point of collection varies about the spool.

8 Claims, 14 Drawing Figures

FIG. 1
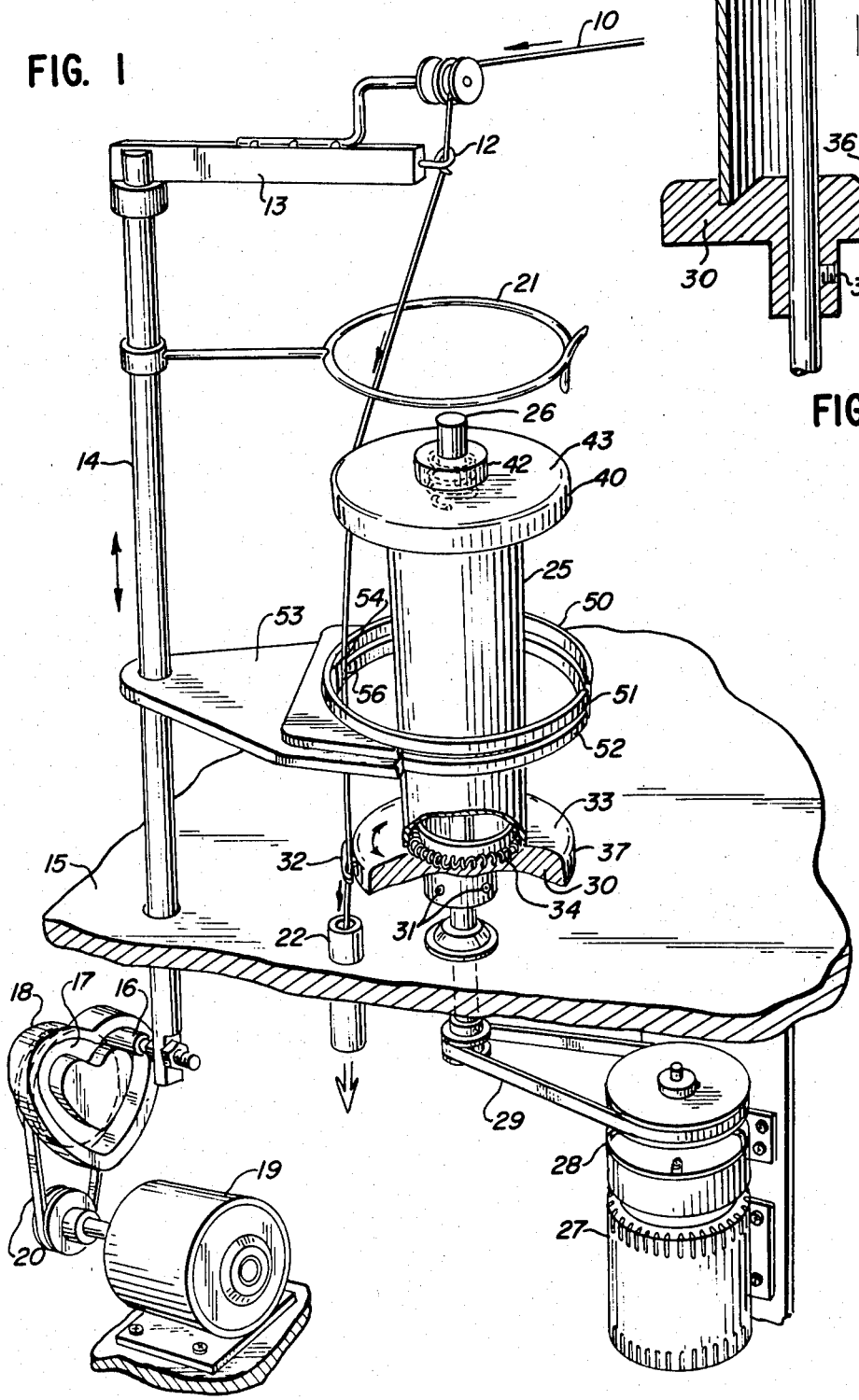
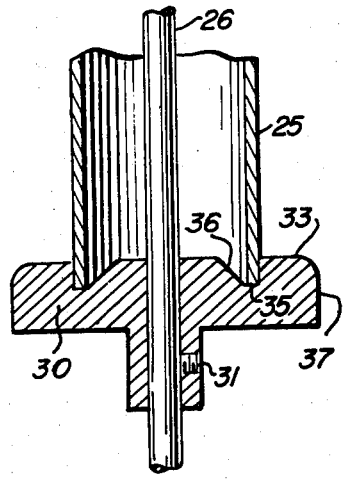
FIG. 2

FIG. 3
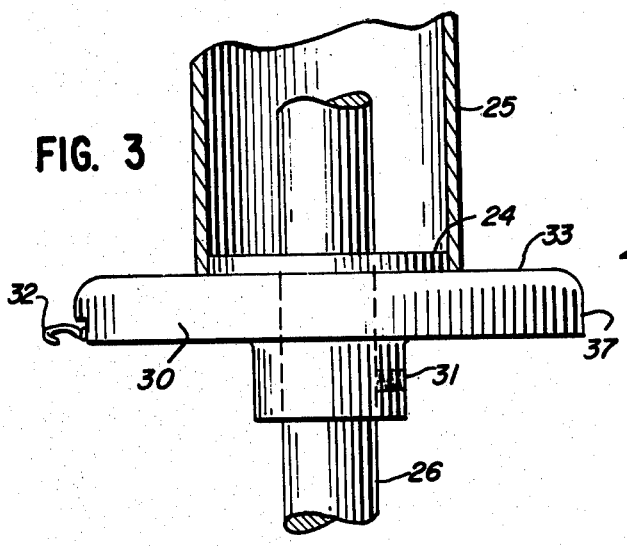
FIG. 4
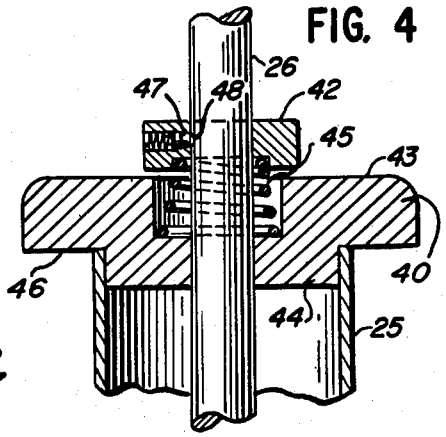
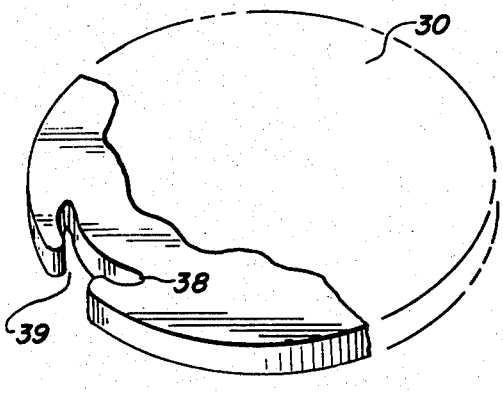
FIG. 5
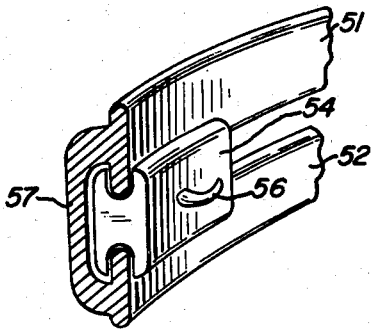
FIG. 6
FIG. 7
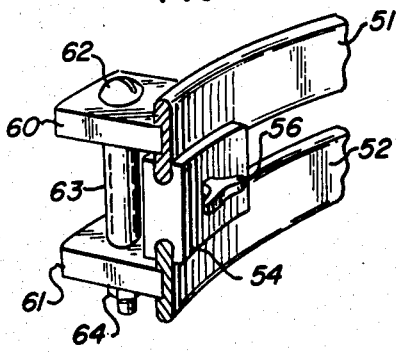

TWISTER RING AND TRAVELER

This is a division of application Ser. No. 7,955, filed January 31, 1979, now U.S. Pat. No. 4,246,746.

BACKGROUND OF THE INVENTION

1. Field of the Invention

The present invention relates to a method and apparatus for winding and twisting yarn onto a hollow spool. The inline twister comprises the following elements: a rotatable spindle, a bottom flange securely fastened to the spindle having a catch on the outer periphery, a removable interlocking top flange positioned on the spindle, means for positioning the spool concentrically about the spindle, a twister ring concentrically positioned about the spindle having a slit, and a rotatable traveler positioned on the twister ring having a hook inwardly directed toward the spindle.

The method of winding and twisting yarn onto a spool comprises guiding the yarn adjacent to the spool. This yarn is then positioned adjacent to the slit in the twister and is allowed to pass therein. The spindle on which the spool is contained is then rotated so that the catch-equipped bottom flange contacts the yarn and holds it tight. As the yarn is rotated by the bottom flange it contacts the hook equipped rotatable traveler positioned on the twister ring and this combination of rotating flange and traveler provides the means for inserting twist into the yarn as well as wrapping the yarn about the spool. As the yarn is wound about the spool the twister ring is reciprocated so that the point of collection varies about the spool.

The present invention utilizes a minimum amount of equipment in accomplishing a task that has required three separate operations in the past. The three separation operations involved winding the yarn on a winder, twisting the yarn on a twister and then rewinding the twisted yarn on a second winder. Thus, a time, cost, and energy saving is realized by using the inline twister.

2. Description of the Prior Art

Presently, in the textile industry there is a need for packages containing wound and twisted yarn. Yarn on spools having a length of from 8½ to 13 inches, an overall diameter of 6 to 12 inches and a "tail" of about 6 inches which is tied onto the leading end of a subsequent yarn package are required by rug, carpet and cloth manufacturers. These spools of yarn must contain a twist of about ½ to 3 turns per inch so as to feed freely into a tufting or weaving machine. The number of turns is determined by the ease with which the yarn can unwind and feed into a machine while not having so many turns that the yarn loses its ability to become fluffy after tufting. The current process of forming such packages of twisted yarn involves three distinct steps. First, the oriented, fibrillated, ribbon, multifilament or other type of yarn produced on a production line is wound onto aluminum spools by continuous winding machines. These machines are capable of being threaded without interruption of the output flowing from the production line such as an extrusion line. Second, the filled spools are transferred to a so-called "twister machine" where the untwisted yarn is unwound from the aluminum spools and twisted onto bobbins. Third, the filled bobbins are removed and placed on a rewinder machine where the yarn is again removed and uniformly wound onto cardboard cones for shipment to a customer.

As can be readily imagined, such an operation involving several intermediate steps tends to be costly and time consuming both in terms of machinery and manpower. Any process which can take the yarn from the production source and directly convert it into a shippable package will substantially lessen production and handling cost and greatly facilitate the entire operation. Up until now, no one has been able to provide such a one-step process for winding and twisting yarn.

The primary reason no one has been able to combine all three operations into one is the fact that no one visualized using our claimed slit twister ring which would allow yarn to be wound directly onto a shippable package. It also appears that the industry was searching for a more complicated solution to this problem and overlooked the basic approach recited herein.

It should also be noted that the prior art method, aside from being more cumbersome, is limited as to the type and quality of package which can be produced. The textile industry, in general, requires a shippable package wherein the yarn is uniformly wound in such a way that it will not slide off the ends of the spool while in transit or storage and yet will unwind evenly, without snags, when placed on a tufting or weaving machine. These requirements have necessitated the use of a hollow cardboard cone rather than a hollow cardboard cylinder. The cones themselves are hard to manufacture and cost twice as much as an ordinary cardboard cylinder, but up until now, these cones were the only devices which would allow the yarn to be easily withdrawn.

Several inventions have been patented which have tried to remedy some of the existing problems such as improving a twister ring or traveler. The most relevant patents are:

U.S. Pat. Nos. 3,398,220 (1968) and 3,492,389 (1970) both by M. I. Port et al. which disclose a process for continuously producing a plurality of packages of bulk yarns from polymeric material. The process comprises: extruding the film material, stretching and drawing the web to orient the film, slitting the film into a plurality of flat ribbons, false-twisting each ribbon to form a yarn, texturizing the yarn to form bulk yarn and winding the bulk yarn into packages.

U.S. Pat. No. 3,546,873 (1970) of P. T. Slack discloses a machine for twisting and winding yarn into a package having drive control means to reduce the torque during threading up to allow the machine to follow any reduction in the speed of delivery of the material to the machine without increasing the tension in the material beyond its breaking point. Also disclosed is a suction waste disposal tube into which the leading end of continuously produced material may be deflected during threading-up.

U.S. Pat. No. 2,083,724 (1937) of G. D. Major discloses a filament twisting device whereby a bundle of filaments can be fed onto a rotating object such as a cone or spool without stopping the rotating member in order to start the winding operation. Also disclosed is an automatic threading ring which encompasses a ring having a path through its periphery through which thread may move until it is picked up by a traveler.

U.S. Pat. No. 2,550,761 (1949) of R. V. Blackwood discloses a traveler ring which has an upper and lower ring member which together form a channel in which a continuous floating ring is contained.

U.S. Pat. No. 1,962,239 (1934) of G. H. Gilligan discloses a ring traveler and support therefore. This patent teaches the use of a C shaped traveler.

U.S. Pat. No. 2,020,873 (1935) of A. M. Bowen discloses a spinning or twisting device which is basically a C shaped traveler.

None of the aforementioned patents disclose the inline twister of this invention nor the method of winding and twisting yarn from a continuous source onto a spool to form a shippable package all in a single operation.

The general object of this invention is to provide a method and apparatus for winding and twisting yarn onto a spool in a single operation. A more specific object of this invention is to provide a new process which allows yarn to be continuously fed from an extrusion line or other production source to the inline twister which winds and twists the yarn onto a spool to form a shippable package.

Another object of this invention is to provide a twister ring which can easily be threaded without the need of manually passing the yarn through it.

A further object of this invention is to provide a traveler which is capable of being rotatably mounted on a split twister ring. The advantage of this traveler is that it cannot easily fly off and strike an operator.

Still another object of this invention is to provide a yarn package having multiple layers of adjacent helical windings of yarn extending between two parallel end surfaces wherein the yarn is wound so that the width between adjacent helical windings gradually increases from the inside to the outside of the package.

Still further an object of this invention is to provide a time, cost and energy saving for winding and twisting yarn onto a spool to form a shippable package.

Other objects and advantages will become apparent to one skilled in the art based upon the ensuing description.

SUMMARY OF THE INVENTION

Briefly this invention provides an apparatus and method for winding and twisting yarn onto a spool to form a shippable package. The new apparatus and method are particularly applicable to the textile industry wherein natural or synthetic fibers are formed onto yarn. The method and apparatus, hereinafter referred to as the inline twister will be described with the spindle in the vertical plane even though the inline twister is capable of operating in other positions. The inline twister comprises a rotatably mounted spindle over which an empty spool is placed, a bottom flange securely fastened to the spindle having a catch on the outer periphery, a removable interlocking top flange positioned on the spindle, means for positioning the spool concentrically about the spindle, a twister ring concentrically positioned about the spindle having a slit through which the yarn can pass, and a rotatable traveler positioned on the twister ring having a hook inwardly directed toward the spindle.

The method of winding and twisting yarn onto a spool comprises: guiding the yarn adjacent to the spool. This yarn is then positioned adjacent to the slit in the twister ring and is allowed to pass therein. The spindle on which the spool is contained is then rotated so that the catch-equipped bottom flange contacts the yarn and holds it tight. As the yarn is rotated by the bottom flange it contacts the hook equipped rotatable traveler positioned on the twister ring and this combination of rotating flange and traveler provides the means for inserting twist into the yarn as well as wrapping the yarn about the spool. As the yarn is wound about the spool the twister ring is reciprocated up and down so that the point of collection varies about the spool. After a sufficient quantity of yarn has been wound onto the spool, the end of the yarn is cut and the package is removed. Another empty spool is locked into place on the spindle and the process is repeated. While the operator is replacing the full spool with an empty one, the advancing yarn can be drawn away through an aspirator and can later be reclaimed.

BRIEF DESCRIPTION OF THE DRAWINGS

FIG. 1 is a perspective view of one configuration of the inline twister showing a partial section of the machine frame to reveal the drive means.

FIGS. 2 and 3 are enlarged views of the bottom flange securely fastened to the spindle about which a spool is concentrically positioned. A catch is also shown positioned on the outer periphery of the flange in FIG. 3.

FIG. 4 is a cross-sectional view of a removable interlocking top flange showing a means for concentrically positioning the spool about the spindle.

FIG. 5 is a perspective view of an alternative catch located on the bottom flange.

FIGS. 6 and 7 are partial cross-sectional views of a twister ring exposing alternative methods for connecting the upper and lower rings.

DETAILED DESCRIPTION OF THE INVENTION

Figure 8:
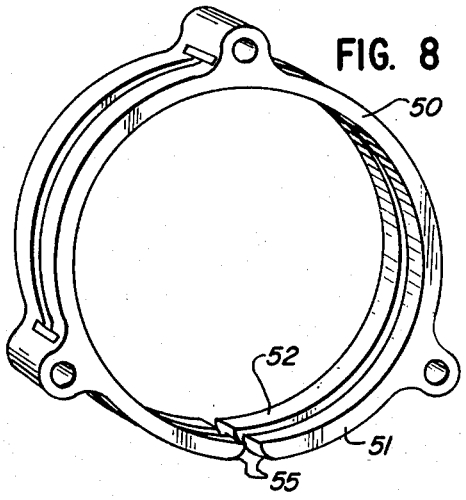
FIG. 8 is a perspective view of a traveler ring.

FIG. 1 shows the inline twister which will be described with the spindle positioned in the vertical plane. It should be noted that the inline twister is capable of operating in other positions, for example, with the spindle in the horizontal plane. The inline twister comprises the following elements, a rotatably mounted spindle 26 connected to a first drive motor 27; a bottom flange 30 securely fastened to spindle 26 having a catch 32 on the outer peripheral edge and a positioning device, such as a garter spring 34 on upper surface 33 which is designed to hold spool 25 concentrically about spindle 26; a removable interlocking top flange 40 which fits over spindle 26 and contacts the upper surface of spool 25 thereby aiding bottom flange 30 in holding spool 25 concentrically in place; a reciprocating support 14, indirectly driven by a second drive motor 19, which holds a yarn guide 11, an optional retainer ring 21 and a twister ring 50; a rotatable traveler 54 positioned on twister ring 50 which has at least one hook 56 inwardly directed toward spindle 26; and an aspirator 22 positioned below bottom flange 30.

In FIG. 1, any oriented, fibrillated, ribbon, spun, multifilament or other type of yarn 10 which is coming from a production line, storage facility or other source is guided over rotatable yarn guide 11, through pig tail 12 downward adjacent to spool 25 into aspirator 22. Both yarn guide 11 and pig tail 12 are attached to guide support 13 affixed to reciprocating support 14 which is slideably mounted in table 15. Cam follower 16 which is attached to the lower end of reciprocating support 14 follows machine race 17 in cam 18 so as to guide reciprocating support 14 upward and downward. Preferably, cam 18 is a positive cam with a channelled race so cam follower 16 can smoothly follow the contour of the race without deflecting away from the contour of the cam. Cam 18, which can vary in configuration depending upon whether a cylindrical or cone shape spool 25 is placed on spindle 26, is rotated by belt drive 20 connected to drive motor 19. Drive motor 19 can be either an AC or DC motor, capable of high torque and slow speed so as to insure uniform motion of cam 18. Preferably, motor 19 is a variable speed D.C. motor. The inline twister is designed so yarn guide 11 can remain a set distance above twister ring 50 so an even tension is existent in incoming yarn 10. This even tension is further satisfied by aspirator 22 which is a tube having an orifice of about $\frac{1}{8}$ inch, to which is applied a reduced pressure. The amount of pull on yarn 10 by aspirator 22 must be sufficient to ensure: (1) take up of yarn 10 as it is supplied from a production or other source, and (2) such that yarn 10 will tear or break after one or more full turns have been applied to spool 25. Preferably, yarn 10 will break and form a tail of 1 to 6 inches after 1–3 complete revolutions of spool 25. Yarn 10 which is drawn into aspirator 22 can then be transferred to a waste storage area or to a reclaim system (both of which are not shown).

After yarn 10 has passed through pig tail 12 it can optionally be directed through retainer ring 21 which will prevent yarn 10 from ballooning outward and thereby slapping against reciprocating support 14. Retainer ring 21 is preferably positioned far enough above top flange 40 so as not to interfere with its removal. It is useful to employ retainer ring 21 when a heavy denier yarn is being wound onto spool 25 because the weight of the yarn increases the ballooning effect. It is also preferred that retainer ring 21 be an open ring having two overlapping ends so as to allow for easy threading of yarn 10 into ring 21 while providing a means for preventing yarn 10 from slipping out of the ring. The tension exerted on yarn 10 by aspirator 22 causes yarn 10 to slide over peripheral surface 43 of top flange 40 and down along spool 25. Spool 25 can be a hollow cylindrical cardboard tube, approximately $10\frac{1}{2}$ inches in height, 3 inches in diameter, $1/16$–$\frac{1}{4}$ inch thick and capable of accepting a build of 6–12 inches, preferably $8\frac{1}{2}$ inches. A "build" is an art term denoting the outside diameter of a spool of yarn when it is completely filled. A build of $8\frac{1}{2}$ inches roughly corresponds to a package of yarn weighing approximately 5 pounds. Although it is advantageous to use a cylindrical spool, other configurations such as a cone shaped spool can be used on the inline twister. When a cone shaped spool is used, the speed of reciprocating support 14 has to be varied so that yarn 10 is traveling faster when it is wound on the smaller diameter end of spool 25. This is necessary to keep the tension in yarn 10 constant so as to ensure that the yarn will not break while being wound. It is also possible to use various size spools made of various materials: such as aluminum, wood, metal or cardboard, with cardboard being the preferred material because of its low cost.

As yarn 10 passes over bottom flange 30 it enters aspirator 22 which is preferably aligned directly beneath the path of catch 32 on outer peripheral surface 37. This will allow yarn 10 to be drawn straight into aspirator 22 without rubbing on outer peripheral surface 37 thereby allowing a steady tension to be exerted on yarn 10. It should be noted that catch 32 will rotate 360° while aspirator 22 remains stationary but at a particular point aspirator 22 will be aligned beneath catch 32. With yarn 10 passing adjacent to spool 25, spindle 26 is rotated by motor 27. Motor 27 is connected to spindle 26 by belt drive 29 and clutch 28. Motor 27 can be either an AC or DC variable speed motor capable of turning spindle 26 at a speed of 2,000 to 10,000 rpm. Preferably, motor 27 is a DC variable speed motor. Motor 27 is also operatively connected to clutch 28 by means of drive couplings (not shown) which permit a transfer of motive power which enables power to be transferred discontinuously through clutch 28. It is also possible to operatively connect motor 27 to several clutches which are connected to several independent spindles. This allows for a multiple spindle setup and is more efficient especially in a production setting. Attached to spindle 26 just above table 15 is bottom flange 30 which is securely fastened to spindle 26 by one or more set screws 31. Bottom flange 30 contains catch 32, which can be either a single hook or a bifurcated hook, located on outer peripheral surface 37. Catch 32 snags yarn 10 as bottom flange 30 is rotated. Since bottom flange 30 can rotate either clockwise or counterclockwise it is preferable to use a bifurcated catch 32 to handle the dual directions of rotation. FIGS. 3 and 5 show two alternative designs for catch 32. In FIG. 3 a conventional wire hook preferably coated with a hard alloy such as chrome or stainless steel is used. Catch 32 should be large enough to allow various size yarns to pass through it without difficulty. A diameter in the range of $3/32$–$\frac{1}{2}$ inch is feasible. In FIG. 5, bifurcated tapered slot 38 is machined into bottom flange 30. Slot 38 which is wider at mouth 39 gradually tapers down in width so as to be capable of engaging various size yarns. The hook shown in FIG. 3 is preferred over the slot shown in FIG. 5.

Bottom flange 30 (see FIGS. 2 and 3) should be constructed of a light-weight material, preferably aluminum, so that it can rotate at high rpm. Bottom flange 30 is circular in configuration and contains a smooth upper surface 33 with rounded or bevelled corners. The smooth corners and edges will prevent yarn 10 from becoming frayed as it builds up on spool 25. The circular configuration of bottom flange 30 is also desirable for a round flange does not vibrate at high speed as much as an unrounded member does. This feature reduces the noise level and wear upon component parts. Located on or attached to upper surface 33 is a positioning device such as garter spring 34, which serves to position spool 25 concentrically about spindle 26. When spool 25 is concentrically positioned about spindle 26, yarn 10 will build up evenly upon spool 25 and a desirable yarn package having evenly spaced helical spirals is produced. This is important for if yarn 10 is incorrectly wound onto spool 25, the yarn 10 will tend to hang up and break when being unwound, a very undesirable feature. In FIG. 1 the positioning device is depicted as garter spring 34 which is a helical spring laid horizontally about the circumference of spindle 26 which is capable of compressing to a smaller diameter when spool 25 is forced upon it. Two other positioning devices are shown in FIGS. 2 and 3. In FIG. 2, the positioning device is an inverted cone shaped circular groove 36 formed in bottom flange 30. Circular groove 36 has a flat bottom surface 35 cut at a radius approximately equal to the radius of spool 25. The outside surface of groove 36 is at right angles to bottom surface 35 to enable spool 25 to be held parallel to spindle 26 and the inside surface is slanted outward to allow for easy alignment of spool 25. Preferably, the inside surface contains a gradual taper slanted outward from spindle 26 so spool 25 will easily be aligned when inserted into groove 36. FIG. 3 shows the positioning device as a simple step member 24 over which spool 25 snugly fits. Although several types of positioning devices have been shown, with garter spring 34 being preferred, it is readily apparent that other configurations which can serve the same function are available and can be utilized. With spool 25 positioned about spindle 26 and resting on bottom flange 30, removable interlocking top flange 40 is positioned over spool 25 and is locked onto spindle 26. Top flange 40 is a circular lightweight member, preferably aluminum, similar to bottom flange 30 except that top flange 40 contains a quick locking mechanism 42 and compression spring 45 (see FIG. 4). In FIG. 4, quick locking mechanism 42 contains a ball and socket joint wherein spring loaded ball 47 snaps into socket 48 located on spindle 26. Preferably, several sockets 48 are located at various heights along spindle 26 to accommodate various length spools. Other variations of quick lock mechanism 42 can include, spring-locks, snaps, keys, screw threads, nuts, etc. Since the full spools will have to be replaced with empty ones, it is desirable to have a light weight top flange 40 which can be easily removed and replaced by the operator with only one hand. Top flange 40 has compression spring 45 located between lock mechanism 42 and positioning device 44. Compression spring 45 is designed to give slightly, up to $\frac{1}{8}$ of an inch, thereby allowing top flange 40 to slightly back away from the buildup of yarn 10 on spool 25. This action prevents a tight seal from forming between yarn 10 and lower surface 46 which would hinder the removal of top flange 40. A tight winding of yarn 10 against lower surface 46 creates a suction force which necessitates added effort in lifting the top flange off spool 25. Top flange 40 also contains a smooth top surface 43 which has rounded or bevelled corners so as to prevent yarn 10 from fraying when passing over it. Top flange 40 contains positioning device 44 to hold the top portion of spool 25 concentrically about spindle 26. Various types of positioning devices 44 can be utilized to satisfy this need. When the positioning device in bottom flange 30 is constructed to firmly hold spool 25 concentrically about spindle 26, positioning device 44 in top flange 40 can be eliminated.

Figure 9:
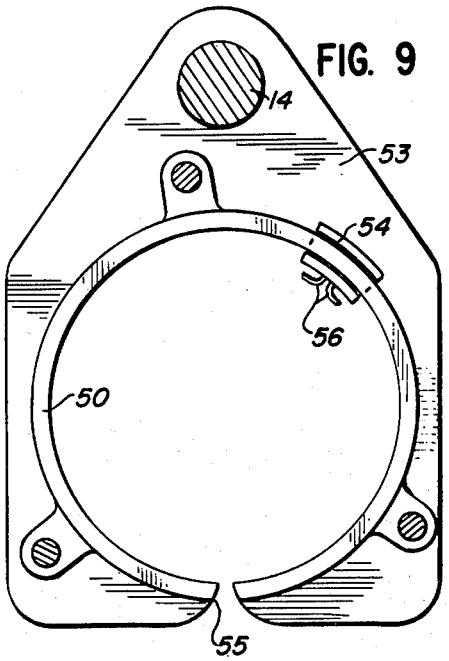
FIGS. 9 and 10 are top views depicting alternative methods for attaching a traveler ring to a ring support.
Figure 10:
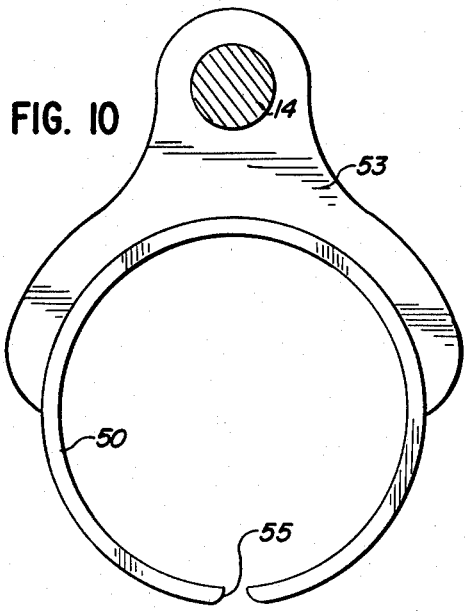

A twister ring 50 is concentrically positioned about spool 25 by ring support 53 which is connected to reciprocating support 14. Twister ring 50 comprises upper and lower rings 51 and 52 which are connected together to form a race or channel, preferably about $1/16$–$\frac{1}{2}$ inch in width, in which a movable traveler 54 is positioned. Upper and lower rings 51 and 52 contain a slit, roughly $1/16$–$\frac{1}{8}$ inch wide, through which yarn 10 may easily pass. FIGS. 8–10 show twister ring 50 with the slit or gap which extends through the circumference of twister ring 50 but preferably is located away from reciprocating support 14. A preferred way of connecting ring support 53 to twister ring 50 is shown in FIG. 10. Rounded edges 55 on both sides of the slit in twister ring 50 allow for yarn 10 to easily pass into the ring. FIGS. 9 and 10 depict alternative arrangements for ring support 53 which can be attached to twister ring 50 in any feasible fashion. In FIG. 9, three screws spaced 120° apart are shown as the fastening means but other mechanical fasteners, such as snaps, welds, screw threads, etc can be used. FIG. 10 shows support 53 and twister ring 50 constructed as a single member. Twister ring 50 can be constructed out of steel or other metallic material, preferably metal and can consist of from one to several members. In FIG. 6, a single piece of metal 57 is formed to provide upper and lower rings 51 and 52. In FIG. 7, several bracket members are used to hold rings 51 and 52 apart. The brackets in FIG. 7 comprise a top plate 60 connected to upper ring 51, bottom plate 61 connected to lower ring 52, sleeve 63 positioned between the two plates 60 and 61, which are fastened together by a screw 62 and nut 64. Other means for connecting rings 51 and 52 together will be apparent to those skilled in the art. Preferably twister ring 50 should contain two thin rings, roughly $1/16$–$\frac{1}{8}$ inch wide, $\frac{1}{2}$–1 inch in height with a $1/16$–$\frac{1}{2}$ inch channel, in which traveler 54 can rotate without a significant amount of friction and without generating an appreciable amount of heat.

Figure 11:
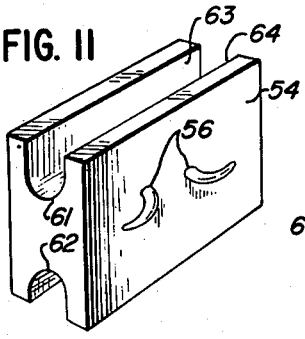
FIGS. 11, 12 and 13 are perspective views of alternative configurations of a traveler with an inwardly directed hook or hooks.
Figure 12:
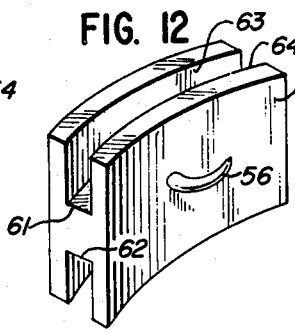
Figure 13:
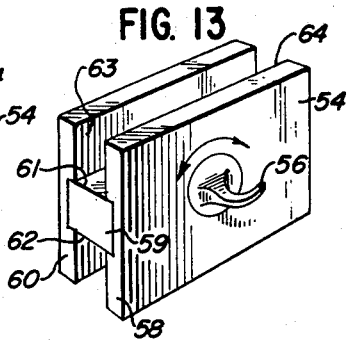

Traveler 54, depicted in FIGS. 11–13, is a lightweight plastic or metal "H" shaped member, constructed of one or more body members, having an inwardly directed hook 56. Traveler 54 is designed to rotate 360° in the channel formed by upper and lower rings 51 and 52 when pulled by yarn 10 passing through hook 56. The "H" shaped design of traveler 54 enables it to rotate at high speeds, for example 10,000 rpm., without flying off twister ring 50. This undesirable feature of having the traveler fly off at high speed has plagued the industry and is frequently encountered when a "C" shaped traveler is employed. The prior art "C" shaped traveler easily becomes distorted by the pressure exerted on it by the yarn and tends to fly off causing a safety problem. Many an operator has been struck by such travelers and has received cuts and bruises from the impact. The traveler of this invention overcomes this troublesome problem for it cannot free itself from twister ring 50. Traveler 54 can be either inserted between rings 51 and 52 before the rings are fastened together or can be assembled onto the rings after they are fastened together. Traveler 54 will contact both upper and lower rings 51 and 52 by middle surfaces 61 and 62 and inside surfaces 63 and 64. There should be little play (room to move back and forth or up and down) between traveler 54 and twister ring 50. This decreases friction and heat, and allows for high speed rotation. Surfaces 61 and 62 can be flat or round, but should conform to the contour edges of rings 51 and 52. As stated previously, traveler 54 can be constructed of a single member as shown in FIGS. 11 and 12 or it can be assembled of several members as shown in FIG. 13. FIG. 13 depicts vertical members 58 and 60 joined together by horizontal member 59 to form an H shaped traveler. Preferably, traveler 54 is slightly curved to match the contour of twister ring 50 as shown in FIG. 12. This eliminates binding and facilitates rotation about the channel formed by rings 51 and 52. Traveler 54 can have various dimensions but must be wide enough to pass over the slit in rings 51 and 52 without difficulty. A length of $\frac{1}{2}$ inch is desirable. One or more metal hooks 56 are attached to traveler 54 and are inwardly directed toward spindle 26. FIGS. 11–13 depict three variations of metal hook 56, the first being two separate hooks, the second a single hook and the third a swivel hook. Other variation of hooks such as the preferred bifurcated hook shown in FIG. 7 can be used. The design of hook 56 is not critical but when hook 56 is bifurcated or swivel mounted it can catch yarn 10 when traveler 54 is rotated either clockwise or counterclockwise. This ability to catch yarn 10 when rotated in either direction is preferred because yarn 10 is usually required to have either a right-twist, known as "S twist", or a left-twist, known as "Z twist". For best results metal hook 56 should be made of stainless steel to prevent wear and should be bent slightly downward from the horizontal plane to decrease the pulling force exerted on it by passing yarn 10. The dimensions of hook 56 are not critical and a 3/32 inch long hook is capable of handling most yarns from the size of light denier yarns to heavy denier yarns.

Yarn 10 is first snagged and held taut by catch 32 on revolving bottom flange 30 and is rotated about spindle 26. As yarn 10 is rotated it contacts hook 56 on traveler 54 and the revolving action of yarn 10 causes traveler 54 to be pulled about twister ring 50. After yarn 10 has made at least one complete revolution, and preferably 2–3 revolutions, the tension exerted by the revolving motion will cause yarn 10 to break below catch 32 forming a tail 66 (see FIG. 14). This tail 66 can vary from a fraction of an inch to several inches, preferably 6 inches. A six inch tail is advantageous for it gives the operator enough yarn to tie into the leading end of a second package in the tufting operation. As catch 32 holds yarn 10 stationary and as traveler hook 56 rotates the yarn, a twist is formed in yarn 10 as it is wound about spool 25. This revolving action of yarn 10 about spindle 26 will cause yarn 10 to be wound onto spool 25 and the number of twists per inch can be controlled by varying the speed of spindle 26 and the incoming line speed of yarn 10. For example with a line speed of approximately 350 feet per minute and a spindle speed of about 4,500 rpm, a twist of one turn per inch is obtained. If the line speed was held constant at 350 fpm and the spindle speed was increased to about 6,000 rpm, a twist of three turns per inch is obtained. As yarn 10 is wound onto spool 25, twister ring 50 is reciprocated along the length of spool 25 so that the point of collection varies along the length of the spool. The speed of spindle 26 in conjunction with the reciprocating motion of twister ring 50 determines the distance between each adjacent helical wrapping. By varying the speed of either spindle 26 or the reciprocating action of twister ring 50 one can obtain a wound package suitable to his needs. As yarn 10 builds upon spool 25 a package 65 is formed and when this package has about an 8–10 inch diameter the operator will cut the incoming yarn. This cutting of the incoming yarn will form a leading end 67 which is used to tie onto tail 66 of the preceding package in the tufting operation. The advancing end of yarn 10 can be placed in aspirator 22 which will remove the yarn and keep it from entangling about the inline twister. Spindle 26 is stopped and the full package is removed, replaced by an empty spool 25, and the process is repeated.

Figure 14:
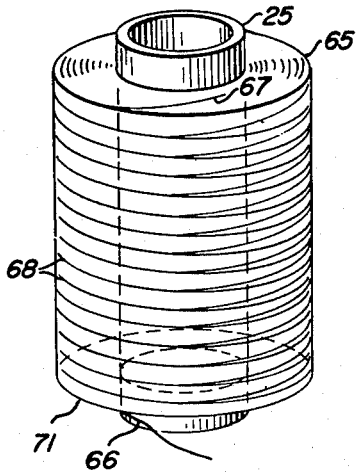
FIG. 14 is an example of a shippable cylindrical yarn package of twisted yarn produced on the inline twister.

FIG. 14 shows an example of finished yarn package 65 which is made on the inline twister. The shape of spool 25 will determine the overall shape of finished yarn package 65. A cylindrical shaped spool will form a cylindrical shaped package and a cone shaped spool will form a cone shaped package. As a result of the way yarn package 65 is made, there is a tail 66 and an end 67. Tail 66 represents the section of yarn 10 which was broken below catch 32 and is useful for tying in subsequent packages on the tufting machines before an existing package has completely run out. This is a current practice in the tufting industry and customers generally request such a visible tail. Yarn package 65 is comprised of: multiple layers of adjacent helical windings of yarn extending between two parallel and preferably flat end surfaces, a tail 66 and a leading end 67. Cylindrical yarn package 65 also has the unique feature in that the width 68 between adjacent helical windings of yarn 10 gradually increases as the outside diameter of the package becomes larger. This gradual change in width 68 occurs because the rate of rotation of spool 25 and reciprocating twister ring 50 are kept constant while the diameter of spool 25 increases. No special gearing is needed to take into account changing diameters of spool 25 as is the custom with present winders and twisters or when a cone shaped spool is present. This gradual change in width 68 aids in removing yarn 10 from package 65 because the pulling force required to remove evenly spaced helical coils of yarn is less than that needed to remove unevenly spaced helical coils. Packages 65 produced on the inline twister also contains flat end surfaces 70 and 71 because as yarn 10 is wrapped or wound about spool 25 it is restricted from bowing outward by both bottom and top flanges 30 and 40 respectively. These two flanges, 30 and 40, prevent yarn 10 from overlapping previously wound layers and thereby eliminate a troublesome problem which has plagued the industry for some time. Top flat surface 70 and bottom flat surface 71 of yarn package 65 gives the package a square appearance because surfaces 70 and 71 are perpendicular to the longitudinal axis of spool 25. This unique design has assisted in giving this yarn package the name "square package." The flat end surface configuration combined with the uniform winding of yarn 10 on each layer of the multiple layer package creates a package which physically stays together and retains its shape while in shipment. This is an improvement over the prior art for packages produced on winders and twisters tend to unravel and become frazzled. When a package loses its shape, the helical windings interlock and it has to be discarded for it cannot be used on the tufting machines.

Cylindrical package 65 produced on the inline twister has the capability of retaining its shape with or without the presence of spool 25 but preferably spool 25 will remain a part of the package.

The inline twister is particularly useful in a production setting where a thermoplastic polymeric material, such as polyethylene, polypropylene, polyamide, polyester or any other suitable resin is extruded. In such a process, the polymeric material is extruded into a film-like web. This film-like web is then slit into a plurality of individual filament ribbon yarns which is heated and drawn. After drawing, the yarn is fibrillated to produce fibrillated yarn which is then simultaneously wound and twisted on the inline twister. Such a process is continuous and can produce a plurality of shippable packages. This process is preferable for flat ribbon yarn which can optionally be texturized before the winding and twisting steps, such as by crimping the ribbon yarn.

The extrusion process can also be used to produce a bulk continuous filament yarn from a thermoplastic polymeric material, such as polyethylene, polypropylene, polyamide, polyester or any other suitable resin. The process of producing a plurality of shippable packages of bulk continuous filament yarn comprises extruding the polymeric material into strains; quenching the strains; heating and drawing the strains; combining multiple strains, for example 2–10 strains, preferably 3 to 5 strains, to produce bulk continuous yarn; texturizing this yarn, such as by crimping, to produce bulk continuous filament yarn; and then simultaneously winding and twisting this bulk continuous filament yarn on the inline twister to produce a plurality of shippable packages.

It should be appreciated that the present invention is not to be construed as being limited by the illustrative embodiments. It is possible to produce still other embodiments without departing from the inventive concepts herein disclosed. Such embodiments are within the ability of those skilled in the art.

We claim:

1. A twister ring, which comprises: two interconnected rings positioned to form a race in which a traveler can rotate, and a slit extending through said rings through which yarn can pass.

2. The twister ring of claim 1 wherein said rings are thin and interconnected on the outer periphery.

3. A traveler which comprises (1) an H-shaped body member having two parallel legs interconnected by a connecting member to form an upper and lower void space between said legs, said body member adapted to be positioned between two interconnected rings having a common axis so that portions of said rings extend into said void spaces, said body member being curved so as to follow the contour of said rings and (2) at least one hook inwardly directed from said body member toward the axis of said rings.

4. The traveler of claim 3 wherein said hook is bifurcated so as to catch yarn when rotated clockwise or counterclockwise.

5. The traveler of claim 3 wherein said body member is a single part.

6. The traveler of claim 3 wherein said body member is constructed of at least two parts.

7. The twister ring of claim 1 wherein said traveler comprises a body member adapted to be positioned between said interconnected rings and having at least one hook inwardly directed toward the axis of said rings.

8. A twister ring comprising two interconnected rings positioned to form a race in which a traveler can rotate and a slit extending through said rings through which yarn can pass said traveler comprising an H shaped body member which is curved so as to follow the contour of said rings and having at least one hook inwardly directed toward the axis of said rings.

* * * * *